US009976399B2

(12) United States Patent
Tolman et al.

(10) Patent No.: US 9,976,399 B2
(45) Date of Patent: May 22, 2018

(54) SELECTIVELY ACTUATED PLUNGERS AND SYSTEMS AND METHODS INCLUDING THE SAME

(71) Applicants: Randy C. Tolman, Spring, TX (US); Federico A. Tavarez, Pearland, TX (US); Pavlin B. Entchev, Moscow (RU); Krishnan Kumaran, Raritan, NJ (US); Michael C. Romer, The Woodlands, TX (US)

(72) Inventors: Randy C. Tolman, Spring, TX (US); Federico A. Tavarez, Pearland, TX (US); Pavlin B. Entchev, Moscow (RU); Krishnan Kumaran, Raritan, NJ (US); Michael C. Romer, The Woodlands, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 610 days.

(21) Appl. No.: 14/597,748

(22) Filed: Jan. 15, 2015

(65) Prior Publication Data

US 2015/0275633 A1 Oct. 1, 2015

Related U.S. Application Data

(60) Provisional application No. 61/970,748, filed on Mar. 26, 2014.

(51) Int. Cl.
*E21B 23/08* (2006.01)
*E21B 43/12* (2006.01)

(52) U.S. Cl.
CPC ..... *E21B 43/121* (2013.01); *E21B 23/08* (2013.01); *E21B 43/122* (2013.01)

(58) Field of Classification Search
CPC ..... E21B 43/121; E21B 23/08; E21B 23/10
See application file for complete search history.

(56) References Cited

U.S. PATENT DOCUMENTS 4,220,212 A * 9/1980 Lands, Jr. ..... E21B 43/11857 175/4
6,170,573 B1 1/2001 Brunet et al.
(Continued)

OTHER PUBLICATIONS

Schlumberger Oilfield Glossary entry for "casing collar log", accessed Dec. 8, 2017 via www.glossary.oilfield.slb.com.*

*Primary Examiner* — Blake E Michener
(74) *Attorney, Agent, or Firm* — ExxonMobil Upstream Research Company-Law Department

(57) ABSTRACT

Selectively actuated plungers and systems and methods including the same are disclosed herein. The methods include flowing a wellbore fluid stream in fluid contact with a plunger and in an uphole direction within a wellbore conduit while the plunger is located within a target region of the wellbore conduit. The methods further include maintaining the plunger in a low fluid drag state while a variable associated with the wellbore fluid stream is outside a threshold range and transitioning the plunger to a high fluid drag state responsive to the variable associated with the wellbore conduit being within the threshold range. The methods further include conveying the plunger in the uphole direction within the wellbore conduit. The systems include the plungers and/or hydrocarbon wells that include the plungers.

27 Claims, 7 Drawing Sheets

(56) References Cited

U.S. PATENT DOCUMENTS 6,360,823 B1 * 3/2002 Ranson ..... E21B 23/00 166/250.11
6,554,580 B1 4/2003 Mayfield et al.
7,219,725 B2 5/2007 Chisholm
7,328,748 B2 2/2008 Giacomino
7,438,125 B2 * 10/2008 Victor ..... E21B 43/127 166/105.2
7,445,048 B2 11/2008 Sheffield
7,690,425 B2 4/2010 Giacomino
7,793,728 B2 * 9/2010 Bender ..... E21B 37/045 166/105
7,963,326 B2 6/2011 Giacomino
8,464,798 B2 6/2013 Nadkrynechny
8,833,467 B2 9/2014 Gong et al.
2002/0084071 A1 * 7/2002 McCoy ..... E21B 43/121 166/255.1
2005/0178543 A1 * 8/2005 Giacomino ..... E21B 43/121 166/250.01
2006/0090893 A1 * 5/2006 Sheffield ..... E21B 43/121 166/250.15
2007/0277975 A1 * 12/2007 Lovell ..... E21B 47/04 166/250.01
2008/0029272 A1 * 2/2008 Bender ..... E21B 43/00 166/372
2011/0079960 A1 * 4/2011 Borden ..... E21B 43/126 277/336
2011/0253382 A1 * 10/2011 Nadkrynechny ..... E21B 43/121 166/372
2012/0132437 A1 * 5/2012 Gong ..... E21B 43/121 166/372
2012/0193091 A1 * 8/2012 Bender ..... E21B 43/121 166/250.15
2013/0319661 A1 * 12/2013 Xiao ..... E21B 43/121 166/250.03
2014/0090837 A1 * 4/2014 Hedtke ..... E21B 43/121 166/255.1
2014/0231079 A1 * 8/2014 Scantlebury ..... E21B 47/00 166/255.1
2015/0060056 A1 * 3/2015 Kumaran ..... E21B 44/005 166/250.01
2015/0075783 A1 * 3/2015 Angman ..... E21B 43/26 166/250.01

* cited by examiner

SELECTIVELY ACTUATED PLUNGERS AND SYSTEMS AND METHODS INCLUDING THE SAME

CROSS REFERENCE TO RELATED APPLICATION

This application claims the benefit of U.S. Provisional Application No. 61/970,748, filed Mar. 26, 2014, the entirety of which is incorporated by reference herein.

FIELD OF THE DISCLOSURE

The present disclosure relates generally to selectively actuated plungers and systems and methods that include the selectively actuated plungers, and more particularly to selectively actuated plungers that selectively initiate motion in an uphole direction within a wellbore conduit.

BACKGROUND OF THE DISCLOSURE

Gaseous hydrocarbon wells often may accumulate liquids within a wellbore conduit thereof. These liquids may slow, resist, block, and/or occlude flow of a wellbore fluid stream within the wellbore conduit, thereby decreasing a production rate of the wellbore fluid stream from the wellbore conduit. This especially may be true late in the lifetime of the gaseous hydrocarbon well and/or after the production rate of the wellbore fluid stream decreases below a threshold production rate.

Plungers may be utilized to remove the accumulated liquids from the wellbore conduit, thereby improving, or increasing, the production rate of the wellbore fluid stream. Historically, plungers either continuously trip (travel) within the wellbore conduit or rest within a lubricator at the surface and are released into the wellbore conduit responsive to surface measurements and controls.

While either of these approaches may be used to remove accumulated liquids from the wellbore conduit under certain conditions, each has distinct limitations. As illustrative, non-exclusive examples, a continuously tripped plunger may generate unnecessary wear of well components and/or constantly may restrict flow of the wellbore fluid stream therepast. As additional illustrative, non-exclusive examples, plungers that are housed within the well's lubricator may rely upon inaccurate surface measurements of well performance and/or may require that the gaseous hydrocarbon well be shut in to permit the plunger to travel into the wellbore conduit to be used to remove liquids from the wellbore conduit. Thus, there exists a need for improved selectively actuated plungers and/or for systems and methods that include the selectively actuated plungers.

SUMMARY OF THE DISCLOSURE

Selectively actuated plungers and systems and methods including the same are disclosed herein. The methods include flowing a wellbore fluid stream in fluid contact with a plunger and in an uphole direction within a wellbore conduit while the plunger is located within a target region of the wellbore conduit. In some embodiments, the target region is distal, or downhole, from a surface region. The methods further include maintaining the plunger in a low fluid drag state while a variable associated with the wellbore fluid stream is outside a threshold range and transitioning the plunger to a high fluid drag state responsive to the variable associated with the wellbore conduit being within the threshold range. The methods further include conveying the plunger in the uphole direction within the wellbore conduit.

In some embodiments, the plunger includes a detector, and the methods include detecting that the variable associated with the wellbore fluid stream is within the threshold range with the detector. In some embodiments, the plunger includes a controller, and the methods include initiating the transitioning with the controller responsive to the detecting. In some embodiments, the methods further include determining a location and/or speed of the plunger within the wellbore conduit with the controller and during the conveying. In some embodiments, the methods further include regulating the speed of the plunger during the conveying. In some embodiments, the regulating includes decreasing or increasing the fluid drag on the plunger within the wellbore conduit to decrease or increase, respectively, the speed of the plunger. In some embodiments, the methods include returning the plunger to the target region of the wellbore conduit without the plunger traversing an entire distance between the target region of the wellbore conduit and a surface region. In some embodiments, the methods further include collecting downhole data with the detector.

In some embodiments, the variable associated with the wellbore fluid stream includes a pressure of the wellbore fluid stream, a flow rate of the wellbore fluid stream, a temperature of the wellbore fluid stream, and/or a density of the wellbore fluid stream. In some embodiments, the variable associated with the wellbore fluid stream includes a plurality of variables associated with the wellbore fluid stream.

In some embodiments, the methods further include repeating at least a portion of the methods. In some embodiments, the repeating includes returning the plunger to the target region of the wellbore conduit and repeating the flowing, the maintaining, the transitioning, and the conveying.

In some embodiments, the methods further include releasing a supplemental material into the wellbore conduit. In some embodiments, the plunger includes a power source and the methods include re-charging the power source. In some embodiments, the methods further include conveying data from the plunger. In some embodiments, the methods further include locating the plunger within the target region of the wellbore conduit.

The systems include the plungers and/or hydrocarbon wells that include the plungers. In some embodiments, the plungers include a drag-regulating structure and the controller. In some embodiments, the controller is programmed to maintain the drag-regulating structure in the low fluid drag state while the variable associated with the wellbore fluid stream is outside the threshold range and to transition the drag-regulating structure to the high fluid drag state responsive to the variable associated with the wellbore fluid stream being within the threshold range. In some embodiments, the controller is further programmed to adjust the drag-regulating structure to adjust the fluid drag on the plunger while the plunger is being conveyed within the wellbore conduit.

DETAILED DESCRIPTION AND BEST MODE OF THE DISCLOSURE

Figure 1:
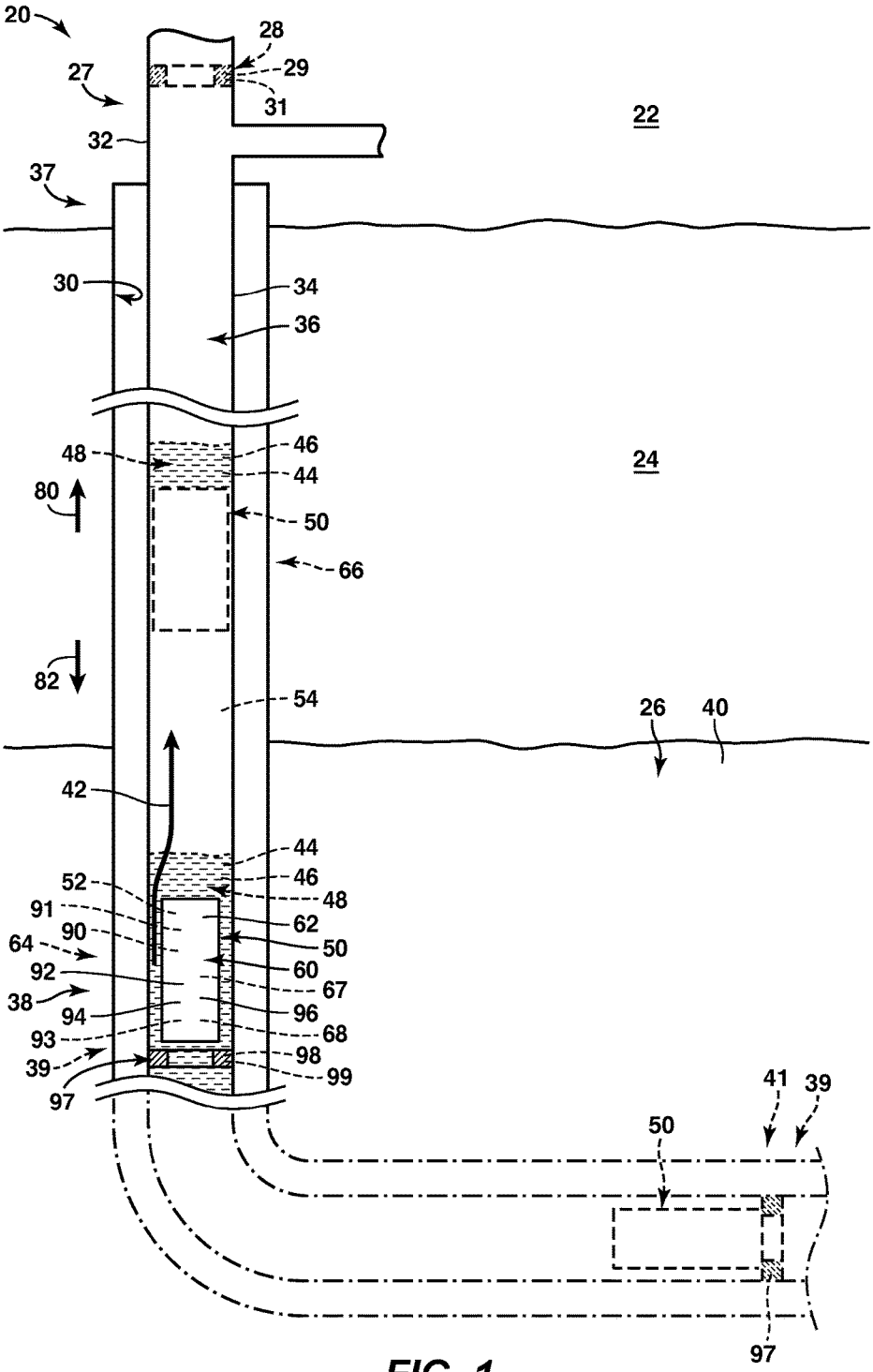
FIG. 1 is a schematic cross-sectional view of illustrative, non-exclusive examples of a hydrocarbon well that may include and/or utilize a plunger according to the present disclosure.

FIGS. 1-20 provide illustrative, non-exclusive examples of plungers 50 according to the present disclosure, of components of plungers 50, and/or of methods and/or process flows that may include and/or utilize plungers 50. Elements that serve a similar, or at least substantially similar, purpose are labeled with like numbers in each of FIGS. 1-20, and these elements may not be discussed in detail herein with reference to each of FIGS. 1-20. Similarly, all elements may not be labeled in each of FIGS. 1-20, but reference numerals associated therewith may be utilized herein for consistency. Elements, components, and/or features that are discussed herein with reference to one or more of FIGS. 1-20 may be included in and/or utilized with any of FIGS. 1-20 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a particular embodiment without departing from the scope of the present disclosure.

FIG. 1 is a schematic cross-sectional view of illustrative, non-exclusive examples of a gaseous hydrocarbon well 20 that may include and/or utilize a plunger 50 according to the present disclosure. Gaseous hydrocarbon well 20 also may be referred to herein as a hydrocarbon well 20 and/or simply as a well 20. Well 20 includes a wellbore 30 that extends between a surface region 22 and a subterranean formation 26 that is present within a subsurface region 24. Well 20 further includes a conduit body 34 that defines a wellbore conduit 36. The wellbore conduit extends within the wellbore, is defined within the wellbore, and/or includes at least a portion of the wellbore.

Plunger 50 is located within a target region 38 of wellbore conduit 36. Target region 38 of wellbore conduit 36 may include and/or be any suitable portion of the wellbore conduit that is located downhole from surface tree 27, that is located and/or defined within subsurface region 24, that is located and/or defined within subterranean formation 26, and/or in which liquid 44 collects. As illustrative, non-exclusive examples, target region 38 may include, be located within, and/or be defined within a portion of subsurface region 24 that provides the wellbore fluid stream to the wellbore conduit and/or within a portion of the wellbore conduit that is distal from an uphole end of the wellbore conduit. As another illustrative, non-exclusive example, target region 38 may be at least a threshold distance from surface region 22 along a length of wellbore 30. Illustrative, non-exclusive examples of the threshold distance include threshold distances of at least 100 meters (m), at least 250 m, at least 500 m, at least 750 m, at least 1,000 m, at least 1,250 m, at least 1,500 m, at least 2,000 m, at least 3,000 m, at least 4,000 m, at least 5,000 m, at least 7,500 m, or at least 10,000 m.

As discussed in more detail herein, plunger 50 may be configured to have and/or define a low fluid drag state 64 and to rest, reside, remain and/or be located within target region 38 of wellbore conduit 36 while a wellbore fluid stream 42 flows past the plunger in an uphole direction 80 within the wellbore conduit. In addition, plunger 50 may be configured to selectively transition from the low fluid drag state to a high fluid drag state 66 responsive to a variable associated with the wellbore fluid stream being within a threshold range. Upon transitioning to the high fluid drag state, the plunger may be conveyed within wellbore conduit 36 in uphole direction 80, as illustrated in dashed lines in FIG. 1, by and/or with wellbore fluid stream 42. This may permit plunger 50 to urge and/or convey a liquid 44 and/or a solid material 46, which may be present within wellbore conduit 36, in the uphole direction. This conveying may thereby permit removal of the liquid and/or the solid material from the wellbore conduit and/or decrease a resistance to the flow of wellbore fluid stream 42 from the subterranean formation, within the wellbore conduit, in the uphole direction, and/or from the gaseous hydrocarbon well.

The variable associated with the wellbore fluid stream may include any suitable variable that is indicative of the presence of, or the presence of at least a threshold volume of, liquid 44 within target region 38 of wellbore conduit 36. Additionally or alternatively, when greater than the threshold volume of liquid 44 is present within target region 38, the variable associated with the wellbore fluid stream is within the threshold range. Illustrative, non-exclusive examples of the variable associated with the wellbore fluid stream may be or include a pressure of the wellbore fluid stream, a density of the wellbore fluid stream, a temperature of the wellbore fluid stream, and/or a flow rate of the wellbore fluid stream. As discussed in more detail herein, the systems and/or methods may monitor and/or detect the magnitude and/or the rate of change of the variable.

Subsequent to being conveyed in uphole direction 80, plunger 50 may transition back to the low fluid drag state 64. This transitioning may occur, for example, after the plunger reaches an uphole end of wellbore conduit 36, and/or urges liquid 44 and/or solid material 46 in uphole direction 80 and/or from wellbore conduit 36. This may permit the plunger to fall, such as under the influence of gravity, in a downhole direction 82 and/or toward target region 38 within wellbore conduit 36. The plunger then may rest, reside, remain and/or be located within the target region of the wellbore conduit, such as for at least a threshold maintaining time, before once again transitioning to the high fluid drag state and being conveyed in uphole direction 80 with wellbore fluid stream 42. This process may be repeated any suitable number of times and/or with any suitable frequency to remove liquid 44 and/or solid material 46 from the wellbore conduit.

Wellbore conduit 36 may be defined by any suitable structure and/or conduit body 34. As an illustrative, non-exclusive example, wellbore conduit 36 may be defined by (or conduit body 34 may be) wellbore 30. As another illustrative, non-exclusive example, wellbore conduit 36 may be defined by (or conduit body 34 may be) a casing string that extends within wellbore 30. As yet another illustrative, non-exclusive example, wellbore conduit 36 may be defined by (or conduit body 34 may be) a tubing or production string that extends within wellbore 30.

As illustrated in FIG. 1, wellbore conduit 36 may define an at least substantially constant cross-sectional shape and/or area along a length thereof. However, it is also within the scope of the present disclosure that wellbore conduit 36 may include and/or be a tapered wellbore conduit 36 that defines a progressively smaller cross-sectional area as the wellbore conduit extends farther from surface region 22 along the length of the wellbore conduit. The tapered wellbore conduit may taper gradually and/or in discrete steps, or stages. When the wellbore conduit is a tapered wellbore conduit, plunger 50 may be adapted, configured, and/or designed to adjust an outer diameter thereof to correspond to an inner diameter of the wellbore conduit at a given location within the wellbore conduit. This may permit the plunger to maintain sufficient fluid drag therepast to be conveyed in the uphole direction with wellbore fluid stream 42 despite changes in the cross-sectional shape and/or area of the wellbore conduit.

As illustrated in solid lines in FIG. 1, wellbore 30 may include and/or be a vertical, or at least substantially vertical, wellbore 30 (or wellbore conduit 36 may include and/or be a vertical, or at least substantially vertical, wellbore conduit 36). However, and as illustrated in dash-dot lines in FIG. 1, wellbore 30 (or wellbore conduit 36) also may include and/or define one or more horizontal and/or deviated regions. As further illustrated in FIG. 1, target region 38 may be located in any suitable portion of wellbore conduit 36, including a vertical portion, a deviated portion, and/or a horizontal portion of the wellbore conduit. When target region 38 is located within a deviated and/or horizontal portion of wellbore conduit 36, a momentum of plunger 50 may be utilized to carry the plunger into the target region when the plunger is conveyed in downhole direction 82 and/or located within the wellbore conduit.

Target region 38 of wellbore conduit 36 may include and/or be any suitable portion of the wellbore conduit that is located downhole from surface tree 27, that is located and/or defined within subsurface region 24, that is located and/or defined within subterranean formation 26, and/or in which liquid 44 collects. As illustrative, non-exclusive examples, target region 38 may include, be located within, and/or be defined within a portion of subsurface region 24 that provides the wellbore fluid stream to the wellbore conduit and/or within a portion of the wellbore conduit that is distal from an uphole end of the wellbore conduit. As another illustrative, non-exclusive example, target region 38 may be at least a threshold distance from surface region 22 along a length of wellbore 30. Illustrative, non-exclusive examples of the threshold distance include threshold distances of at least 100 meters (m), at least 250 m, at least 500 m, at least 750 m, at least 1,000 m, at least 1,250 m, at least 1,500 m, at least 2,000 m, at least 3,000 m, at least 4,000 m, at least 5,000 m, at least 7,500 m, or at least 10,000 m.

As illustrated in FIG. 1, well 20 further may include a downhole support structure 97. Downhole support structure 97 may be configured to support, locate, and/or retain plunger 50 when the plunger is located within target region 38 of wellbore conduit 36. As discussed in more detail herein, plunger 50 may include a power source 94, such as a battery. Under these conditions, downhole support structure 97 may include a downhole electrical connection 98 that is configured to provide an electric current to power source 94, such as to charge the power source. As also discussed in more detail herein, plunger 50 may include a detector 92 that is configured to detect the variable associated with the wellbore fluid stream and/or one or more other variables that may be representative of conditions proximal to plunger 50 within wellbore conduit 36. Downhole support structure 97 also may include a downhole data transfer structure 99 that may be configured to permit and/or facilitate data transfer to and/or from plunger 50.

Well 20 also may include an uphole support structure 28. Uphole support structure 28 which may be associated with, near, and/or proximal to an uphole end of wellbore 36, may be associated with, near, and/or proximal to a surface tree 27 that is associated with well 20 and/or that is configured to selectively regulate flow of wellbore fluid stream 42 from well 20. As a further example, uphole support structure 28 may be located within a lubricator 32 of surface tree 27. Similar to downhole support structure 97, uphole support structure 28 may include an uphole electrical connection 29 and/or an uphole data structure 31, which may be at least substantially similar to downhole electrical connection 98 and or downhole data transfer structure 99. When plunger 50 is conveyed in uphole direction 80, near surface region 22, into surface tree 27, and/or into contact with uphole support structure 28, the plunger may be retained on uphole support structure 28 to permit charging of power source 94 and/or to permit data transfer to and/or from the plunger.

Plunger 50 may include any suitable structure that may be conveyed within wellbore conduit 36 to selectively define and/or transition between low fluid drag state 64 and high fluid drag state 66, and/or may urge or otherwise remove liquid 44 and/or solid material 46 from wellbore conduit 36. Plunger 50 further is configured to define and/or transition between low fluid drag state 64 and high fluid drag state 66, and/or may urge or otherwise remove liquid 44 and/or solid material 46 from wellbore conduit 36. As an illustrative, non-exclusive example, plunger 50 may include a drag-regulating structure 60, which is configured to selectively vary a fluid drag therepast, thereby transitioning, or permitting plunger 50 to transition, between the low fluid drag state and the high fluid drag state. As another illustrative, non-exclusive example, plunger 50 may include and/or at least partially define a flow-through opening 62, which is configured to permit wellbore fluid stream 42 to flow therethrough at least when plunger 50 is in low fluid drag state 64. Illustrative, non-exclusive examples of plungers 50, drag-regulating structure 60, flow-through openings 62, components thereof, features thereof, and/or operation thereof are discussed in more detail herein.

As discussed herein, the low fluid drag state may define a lower relative resistance to fluid flow past the plunger within the wellbore conduit, while the high fluid drag state may define a higher relative resistance to fluid flow past the plunger within the wellbore conduit. Thus, transitioning from the low fluid drag state to the high fluid drag state also may be referred to herein as increasing the resistance to fluid flow past the plunger within the wellbore conduit. Conversely, transitioning from the high fluid drag state to the low fluid drag state also may be referred to herein as decreasing the resistance to fluid flow past the plunger within the wellbore conduit. The resistance to fluid flow past the plunger may correspond to a pressure drop across the plunger within the wellbore conduit (with a higher resistance to fluid flow corresponding to a higher pressure drop) and/or to a fluid drag force on the plunger within the wellbore conduit (with a higher resistance to fluid flow corresponding to a higher fluid drag force). As discussed in more detail herein, transitioning between the high fluid drag state and the low fluid drag state may include changing a cross-sectional area of flow-through opening 62, though this is not required in all embodiments. The high and low fluid drag states additionally or alternatively may be referred to as high and low fluid drag configurations, expanded and contracted configurations, and/or conveying and maintaining configurations, respectively.

Plunger 50 further may include a controller 90. The controller may be adapted, configured, designed, and/or programmed to control the operation of plunger 50. As an illustrative, non-exclusive example, controller 90 may be programmed to control and/or regulate the transitioning of plunger 50 between the low fluid drag state and the high fluid drag state. As another illustrative, non-exclusive example, controller 90 may be programmed to perform any suitable portion of methods 100, which are discussed in more detail herein. This may include performing at least the maintaining at 120 and the transitioning at 135 of subsequently discussed methods 100. This also may include storing the methods within an internal memory 96 of the controller and/or retrieving the methods from the internal memory to permit and/or facilitate execution of the methods.

Plunger 50 also may include and/or controller 90 may be in communication with detector 92, as discussed in more detail herein. In addition, plunger 50 may include a transmitter 91 and/or a receiver 93. Transmitter 91 and/or receiver 93 may permit controller 90 to transmit and/or receive data, as discussed in more detail herein.

It is within the scope of the present disclosure that plunger 50 and/or controller 90 thereof may be adapted, configured, designed, and/or programmed to release, or regulate a release of, supplemental material 54 into wellbore conduit 36. As an illustrative, non-exclusive example, plunger 50 may include a supplemental material reservoir 52, and controller 90 may direct plunger 50 to release supplemental material 54 from supplemental material reservoir 52 and into the wellbore conduit. As another illustrative, non-exclusive example, plunger 50 and/or downhole support structure 97 may be configured to release supplemental material 54 upon and/or concurrent with transitioning of the plunger to the high fluid drag state. As a further illustrative, non-exclusive example, controller 90 may direct supplemental material 54 to be released into wellbore conduit 36 from surface region 22. Illustrative, non-exclusive examples of supplemental material 54 include any suitable foaming agent, soap, surfactant, lubricant, and/or mixtures thereof. Additional illustrative, non-exclusive examples of supplemental material 54 include inhibitors, such as a scale inhibitor, corrosion inhibitor, paraffin inhibitor, etc.

As discussed in more detail herein, plunger 50 may be adapted, configured, sized, and/or designed to permit wellbore fluid stream 42 to flow therepast when the plunger is located within target region 38 of wellbore conduit 36 and the plunger is in the low fluid drag state. It is within the scope of the present disclosure that the wellbore fluid stream may flow past the plunger in any suitable manner. As an illustrative, non-exclusive example, and as illustrated in FIGS. 3-16, plunger 50 may define an internal flow-through opening 62, and the wellbore fluid stream may flow through the internal flow-through opening. Such a flow-through opening also may be referred to herein as an internal flow-through opening 67.

As another illustrative, non-exclusive example, and as illustrated in FIGS. 9-10 and 17-19, plunger 50 and conduit body 34 together may define an annular flow-through opening 62 therebetween, and the wellbore fluid stream may flow through the annular flow-through opening. Such an annular flow-through opening may be external to and/or defined by an external surface of plunger 50 and also may be referred to herein as an external flow-through opening 68.

Wellbore fluid stream 42 may include any suitable wellbore fluid 40 that may flow from subterranean formation 26, may flow through wellbore conduit 36, and/or may be produced from gaseous hydrocarbon well 20. Generally, wellbore fluid stream 42 will include and/or be a gaseous stream and/or a vaporous stream, and illustrative, non-exclusive examples of wellbore fluid stream 42 include a gaseous hydrocarbon stream, a vaporous hydrocarbon stream, a methane stream, and/or a natural gas stream.

Liquid 44 may include any suitable liquid that may accumulate within wellbore conduit 36, may be present within wellbore conduit 36, and/or may (at least partially) restrict flow of wellbore fluid stream 42 within wellbore conduit 36. Illustrative, non-exclusive examples of liquid 44 include water and/or a liquid hydrocarbon. Solid material 46 may include any suitable solid, solid-like, and/or gel material that may accumulate within wellbore conduit 36, may be present within wellbore conduit 36, and/or may (at least partially) restrict flow of wellbore fluid stream 42 within wellbore conduit 36. Illustrative, non-exclusive examples of solid material 46 include a paraffin, a wax, and/or scale. Liquid 44 and/or solid material 46 present in wellbore conduit 36 generally may be referred to herein as wellbore material 48.

As used herein, uphole direction 80 may include any suitable direction that is along (or parallel to) a respective length (or portion) of wellbore conduit 36 and that is directed toward, or closer to, an intersection of the wellbore conduit with surface region 22 and/or toward surface tree 27, when present. Additionally or alternatively, moving an object in the uphole direction also may be described as moving the object in a direction along a trajectory of wellbore conduit 36 that tends to decrease a distance between the object and a surface terminal end 37 of wellbore conduit 36.

Conversely, downhole direction 82 may include any suitable direction that is along (or parallel to) the respective length (or portion) of wellbore conduit 36 and that tends to move away from the intersection of the wellbore with surface region 22, away from surface tree 27, away from surface terminal end 37, toward a subterranean terminal end 39 of wellbore conduit 36, and/or toward a toe 41 (when present) of wellbore conduit 36.

Surface tree 27 may include and/or be any suitable structure that may be configured to control and/or regulate at least a portion of the fluid flows into and/or out of well 20. As illustrative, non-exclusive examples, surface tree 27 may include one or more valves, spools, and/or fittings. Surface tree 27 also may be referred to herein as a Christmas tree 27, a surface valve assembly 27, and/or as a surface flow control assembly 27.

Figure 2:
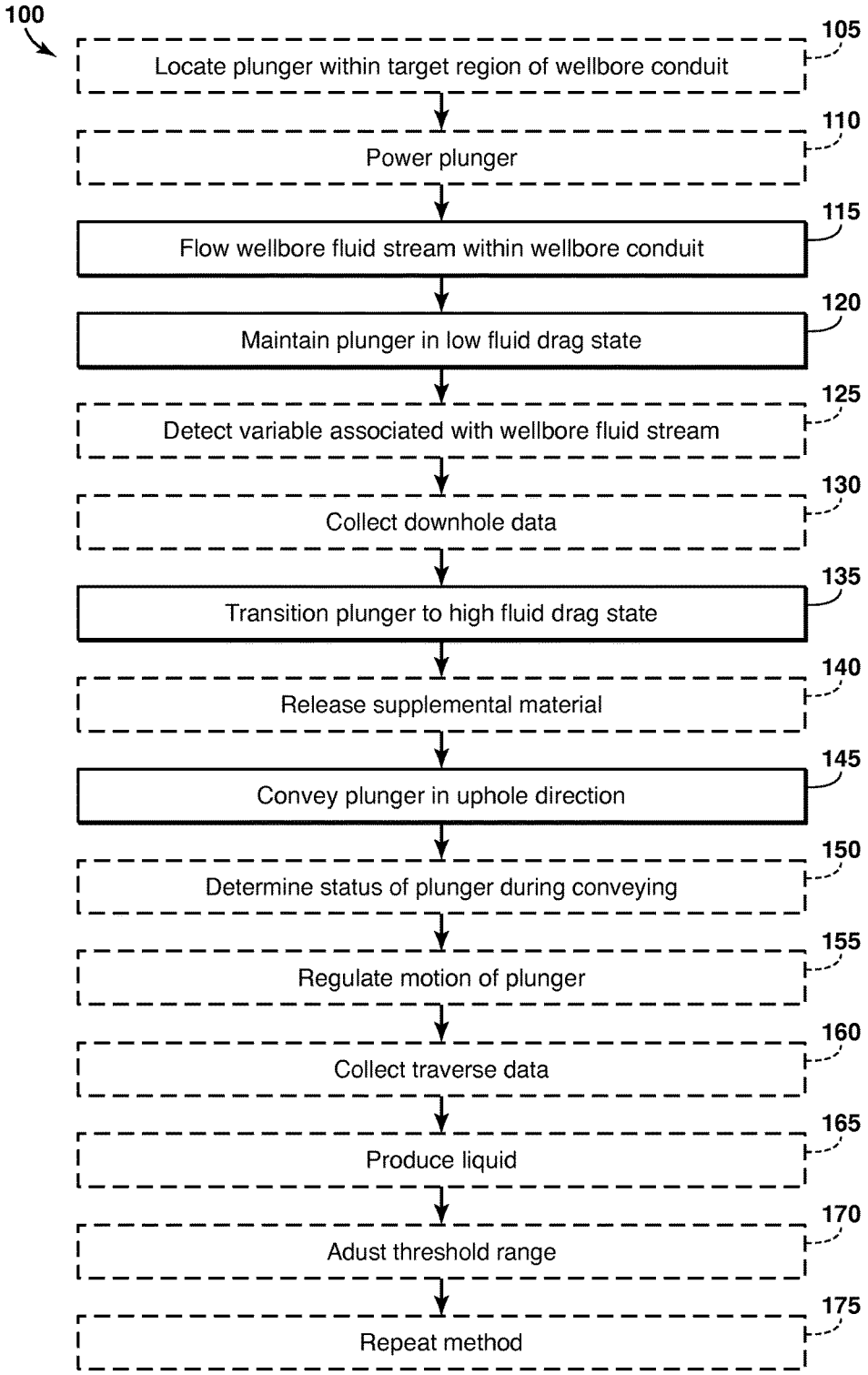
FIG. 2 is a flowchart depicting methods according to the present disclosure of removing a liquid from a wellbore conduit of a gaseous hydrocarbon well with a plunger.

FIG. 2 is a flowchart depicting methods 100 according to the present disclosure of removing a liquid from a wellbore conduit of a gaseous hydrocarbon well with a plunger, while FIGS. 4-8 provide illustrative, non-exclusive examples of a process flow that may be utilized with a plunger according to the present disclosure and/or that may illustrate methods 100. Methods 100 may include locating the plunger within a target region of the wellbore conduit at 105 and/or powering the plunger at 110. Methods 100 include flowing a wellbore fluid stream within the wellbore conduit at 115 and maintaining the plunger in a low fluid drag state at 120. Methods 100 may include detecting a variable associated with the wellbore fluid stream at 125 and/or collecting downhole data at 130. Methods 100 further include transitioning the plunger to a high fluid drag state at 135 and may include releasing a supplemental material 54 into the wellbore conduit at 140. Methods 100 further include conveying the plunger in an uphole direction within the wellbore conduit at 145 and may include determining a status of the plunger during the conveying at 150, regulating a motion of the plunger at 155, collecting traverse data with the plunger at 160, producing a liquid from the gaseous hydrocarbon well at 165, adjusting a threshold range at 170, and/or repeating the methods at 175.

Locating the plunger within the target region of the wellbore conduit at 105 may include locating the plunger within any suitable target region of the wellbore conduit in any suitable manner. As an illustrative, non-exclusive example, the locating at 105 may include lubricating the plunger into the wellbore conduit. As another illustrative, non-exclusive example, the locating at 105 may include permitting the plunger to fall within the wellbore conduit under the influence of gravity and/or permitting the plunger to fall within the wellbore conduit concurrently with (and/or in a direction that is opposed to) the flowing at 115. It is within the scope of the present disclosure that the locating at 105 may include locating the plunger within the target region of the wellbore conduit without shutting in the well and/or without exposing the wellbore conduit to ambient atmospheric conditions and/or ambient atmospheric pressure.

As used herein, the phrase, "shutting in" may include and/or refer to sealing the hydrocarbon well, ceasing production of the wellbore fluid stream from the hydrocarbon well, and/or ceasing flow of the wellbore fluid stream in the uphole direction within the wellbore conduit. Traditional plungers may require that the hydrocarbon well be shut in to permit the traditional plunger to move in a downhole direction within the wellbore conduit. However, plungers according to the present disclosure, which define the low fluid drag state, may be configured to move in the downhole direction under the influence of gravity while the wellbore fluid stream is flowing in the uphole direction within the wellbore conduit.

Figure 3:
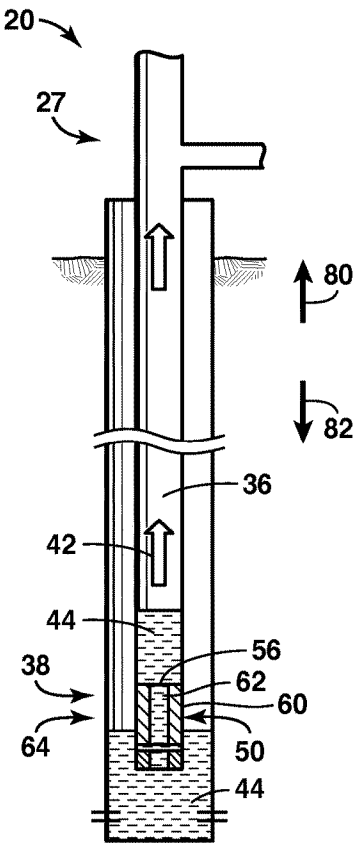
FIG. 3 is a schematic view of an illustrative, non-exclusive example of a portion of a process flow that may be utilized with a plunger according to the present disclosure.
Figure 8:
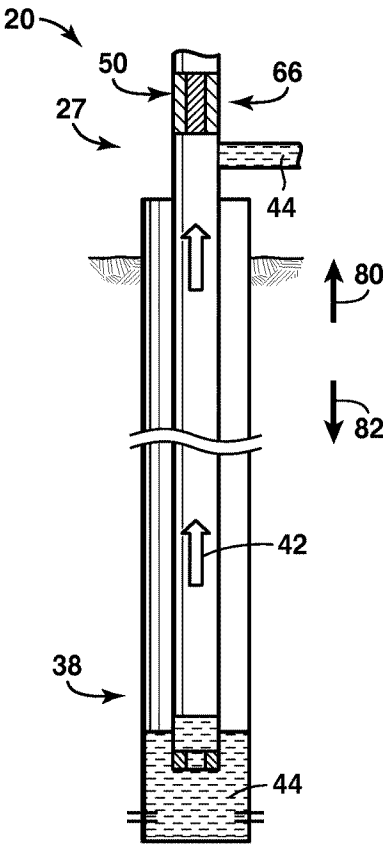
FIG. 8 is a schematic view of an illustrative, non-exclusive example of another portion of the process flow.

Powering the plunger at 110 may include powering any suitable portion of the plunger in any suitable manner. As an illustrative, non-exclusive example, the powering at 110 may include providing an electric current to and/or from any suitable portion of the plunger. As another illustrative, non-exclusive example, and as discussed, the plunger may include a power source, such as a battery, and the powering at 110 may include powering with the power source. When methods 100 include the powering at 110, methods 100 further may include charging and/or re-charging the power source. This may include charging and/or re-charging the power source while the plunger is located within the target region of the wellbore conduit (as illustrated in FIG. 3) and/or charging and/or re-charging the power source while the plunger is located proximal to and/or near the surface region (as illustrated in FIG. 8). The charging and/or re-charging may occur while the plunger is supported by uphole or downhole support structure 28 and 97, such as when the plunger is in electrical contact with an uphole or downhole electrical connection 29 or 98 thereof. It is within the scope of the present disclosure that the charging and/or re-charging may include providing an electric current to the wellbore conduit to permit, facilitate, and/or accomplish the charging and/or re-charging. Additionally or alternatively, it is also within the scope of the present disclosure that the charging and/or re-charging may include generating the electric current within the wellbore conduit, such as by harvesting energy from the wellbore conduit.

Flowing the wellbore fluid stream within the wellbore conduit at 115 may include flowing the wellbore fluid stream within the wellbore conduit in an uphole direction. This may include flowing the wellbore fluid stream past the plunger while the plunger is located within the target region of the wellbore conduit, flowing the wellbore fluid stream in contact with the plunger while the plunger is located within the target region of the wellbore conduit, flowing the wellbore fluid stream through the plunger while the plunger is located within the target region of the wellbore conduit, and/or flowing the wellbore fluid stream through a flow-through opening that is at least partially defined by the plunger while the plunger is located within the target region of the wellbore conduit.

Maintaining the plunger in the low fluid drag state at 120 may include maintaining the plunger in the low fluid drag state while the variable associated with the wellbore fluid stream is outside a threshold range. The maintaining at 120 may include maintaining the plunger in the low fluid drag state during the flowing at 115, and a fluid drag on the plunger when the plunger is in the low fluid drag state may be sufficiently low to permit the plunger to remain within the target region of the wellbore conduit despite and/or during the flowing at 115. Additionally or alternatively, the maintaining at 120 also may include maintaining the plunger within the target region of the wellbore conduit, maintaining the plunger at least substantially motionless within the wellbore conduit, and/or maintaining the plunger in contact with a downhole support structure.

It is within the scope of the present disclosure that the maintaining at 120 may include maintaining the plunger in the low fluid drag state for at least a threshold maintaining time. Illustrative, non-exclusive examples of the threshold maintaining time include threshold maintaining times of at least 1 minute, at least 5 minutes, at least 10 minutes, at least 30 minutes, at least 1 hour, at least 2 hours, at least 5 hours, at least 12 hours, at least 1 day, at least 2 days, at least 3 days, or at least 1 week.

During the maintaining at 120, and as illustrated in FIG. 3, liquid 44 may collect within target region 38 of casing conduit 36 and/or may collect on an uphole side 56 of plunger 50. This liquid may block, occlude, resist, and/or increase a resistance to flow of wellbore fluid stream 42 in uphole direction 80 within wellbore conduit 36, thereby decreasing a production rate of the wellbore fluid stream from gaseous hydrocarbon well 20. Thus, it may be desirable to periodically remove this liquid from the wellbore conduit, as discussed.

Detecting the variable associated with the wellbore fluid stream at 125 may include detecting the variable with any suitable type and/or number of detector(s). The detecting at 125 may include detecting any suitable variable that is associated with the wellbore fluid stream, is indicative of one or more properties of the wellbore fluid stream, and/or is indicative of the presence of liquid within the target region of the wellbore conduit. The detecting at 125 may include detecting that the variable associated with the wellbore fluid stream is within the threshold range and/or outside the threshold range. Illustrative, non-exclusive examples of the variable associated with the wellbore fluid stream are discussed herein.

Collecting downhole data at 130 may include collecting any suitable downhole data with the plunger, with the detector, and/or with a controller that forms a portion of the plunger and/or that is in communication with the detector. The collecting at 130 may include collecting the downhole data while the plunger is within the target region of the wellbore conduit and/or during the maintaining at 120. Illustrative, non-exclusive examples of the collected downhole data include a downhole pressure of the wellbore fluid stream, a downhole flow rate of the wellbore fluid stream, a downhole temperature of the wellbore fluid stream, and/or a downhole density of the wellbore fluid stream. It is within the scope of the present disclosure that the collecting at 130 may include collecting a single data point, collecting the downhole data at a single point in time, and/or collecting the downhole data as a function of time. It is also within the scope of the present disclosure that the downhole data may include and/or be the variable associated with the wellbore fluid stream and/or that the collecting at 130 may be performed concurrently with, and/or may be a result of, the detecting at 125.

The collecting at 130 may include generating a database of downhole data. This database of downhole data may, at least temporarily, be stored within the plunger, such as within a memory device thereof. Additionally or alternatively, the downhole data and/or the database of downhole data may be transferred from the plunger, stored on another device, and/or utilized to document and/or model the behavior and/or performance of the hydrocarbon well. As an illustrative, non-exclusive example, and when methods 100 include the collecting at 130, the methods further may include conveying the data from the plunger and/or to the surface region. This may include conveying the data from the plunger in any suitable manner and/or at any suitable time during methods 100, such as during the charging and/or re-charging that is discussed herein with reference to the powering at 110 and illustrated in FIG. 8.

Transitioning the plunger to the high fluid drag state at 135 may include transitioning responsive to the variable associated with the wellbore fluid stream being within the threshold range. The transitioning at 135 may include increasing a resistance to fluid flow past the plunger within the wellbore conduit, which may increase fluid drag on the plunger and/or provide a motive force for the conveying at 145.

It is within the scope of the present disclosure that the transitioning at 135 may be performed and/or accomplished in any suitable manner. As an illustrative, non-exclusive example, and when the plunger includes the detector and the controller, the transitioning at 135 may be regulated and/or controlled by the controller, such as responsive to the detecting at 125. Under these conditions, the transitioning at 135 may be initiated by the controller automatically and/or without user intervention. However, it is also within the scope of the present disclosure that the transitioning at 135 may include transitioning responsive to receipt of a transition initiation signal by the controller. Such a transition initiation signal may originate within the surface region and/or from a user.

As another illustrative, non-exclusive example, the plunger may include a passive transition device. The passive transition device may be configured to passively transition the plunger from the low fluid drag state to the high fluid drag state responsive to the variable associated with the wellbore fluid stream transitioning from outside the threshold range to within the threshold range. Additionally or alternatively, the passive transition device also may be configured to passively transition the plunger from the high fluid drag state to the low fluid drag state responsive to the variable associated with the wellbore fluid stream transitioning from within the threshold range to outside the threshold range.

Figure 4:
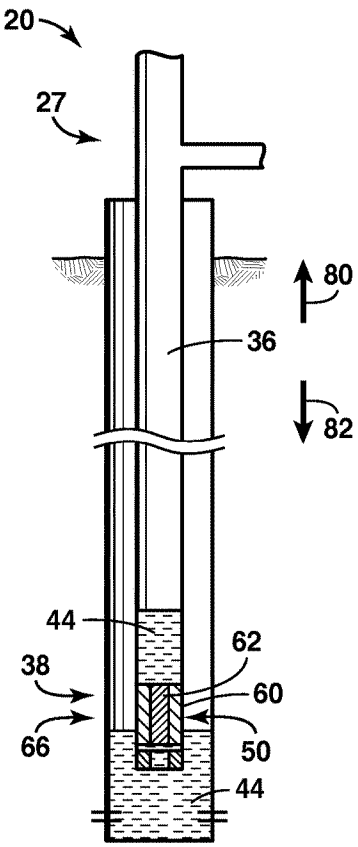
FIG. 4 is a schematic view of an illustrative, non-exclusive example of another portion of the process flow.

The transitioning at 135 may be accomplished in any suitable manner. As an illustrative, non-exclusive example, the transitioning at 135 may include increasing an outer diameter of the plunger. As another illustrative, non-exclusive example, the transitioning at 135 may include decreasing a cross-sectional area of an annular space that is defined by the plunger and a conduit body that defines the wellbore conduit. As yet another illustrative, non-exclusive example, and as illustrated in FIG. 4, the transitioning at 135 may include decreasing, or even eliminating, a cross-sectional area of flow-through opening 62 that is defined by, or within, the plunger.

It is within the scope of the present disclosure that the threshold range of the variable associated with the wellbore fluid stream may be defined in any suitable manner. As an illustrative, non-exclusive example, the variable associated with the wellbore fluid stream may include and/or be the pressure of the wellbore fluid stream. Under these conditions, the transitioning at 135 may include transitioning responsive to the pressure of the wellbore fluid stream exceeding a threshold maximum wellbore fluid stream pressure, responsive to a predetermined temporal pattern in the pressure of the wellbore fluid stream, responsive to a rate of change of the pressure of the wellbore fluid stream, and/or responsive to the rate of change of the pressure of the wellbore fluid stream being less than a threshold minimum rate of change of the pressure of the wellbore fluid stream.

As another illustrative, non-exclusive example, the variable associated with the wellbore fluid stream may include and/or be the temperature of the wellbore fluid stream.

Under these conditions, the transitioning at 135 may include transitioning responsive to the temperature of the wellbore fluid stream being greater than a threshold maximum wellbore fluid stream temperature, responsive to a rate of change of the temperature of the wellbore fluid stream, and/or responsive to the rate of change of the temperature of the wellbore fluid stream being less than a threshold minimum rate of change of the temperature of the wellbore fluid stream.

As yet another illustrative, non-exclusive example, the variable associated with the wellbore fluid stream may include and/or be the flow rate of the wellbore fluid stream. Under these conditions, the transitioning at 135 may include transitioning responsive to the flow rate of the wellbore fluid stream being less than a threshold minimum flow rate of the wellbore fluid stream and/or responsive to a change (or decrease) in the flow rate of the wellbore fluid stream that is greater than a threshold rate of change (or decrease) in the flow rate of the wellbore fluid stream.

As another illustrative, non-exclusive example, the variable associated with the wellbore fluid stream may include and/or be the density of the wellbore fluid stream. Under these conditions, the transitioning at 135 may include transitioning responsive to the density of the wellbore fluid stream being greater than a threshold wellbore fluid stream density.

It is within the scope of the present disclosure that the transitioning at 135 may include transitioning responsive to a single variable associated with the wellbore fluid stream. Additionally or alternatively, it is also within the scope of the present disclosure that the transitioning at 135 may include transitioning responsive to a plurality of variables associated with the wellbore fluid stream (or that the variable associated with the wellbore fluid stream includes a plurality of variables associated with the wellbore fluid stream). This may include transitioning responsive to at least two, at least three, or more than three variables associated with the wellbore fluid stream being within respective threshold ranges. As a more specific but still illustrative, non-exclusive example, the transitioning at 135 may include transitioning responsive to the temperature of the wellbore fluid stream, the pressure of the wellbore fluid stream, and the density of the wellbore fluid stream all being within respective threshold ranges.

Releasing the supplemental material into the wellbore conduit at 140 may include releasing any suitable supplemental material into the wellbore conduit in any suitable manner. Illustrative, non-exclusive examples of the supplemental material are disclosed herein.

As an illustrative, non-exclusive example, the releasing at 140 may include releasing the supplemental material from the plunger while the plunger is within the target region of the wellbore conduit. As another illustrative, non-exclusive example, the releasing at 140 also may include releasing the supplemental material from the plunger while the plunger is being conveyed in the uphole direction within the wellbore conduit. As yet another illustrative, non-exclusive example, the releasing at 140 also may include releasing the supplemental material into an annular space that may be defined between the conduit body and the wellbore.

It is within the scope of the present disclosure that the releasing at 140 may be based upon and/or initiated responsive to any suitable criteria. As an illustrative, non-exclusive example, the releasing at 140 may be based, at least in part, on a value of the variable associated with the wellbore fluid stream. As another illustrative, non-exclusive example, the releasing may be initiated based upon, responsive to, concurrently with, and/or prior to the transitioning at 140 and/or the conveying at 145.

Figure 5:
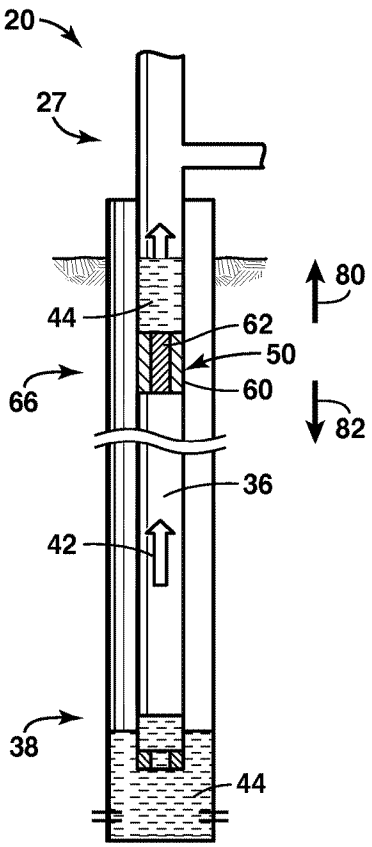
FIG. 5 is a schematic view of an illustrative, non-exclusive example of another portion of the process flow.

Conveying the plunger in the uphole direction within the wellbore conduit at 145 may include conveying the plunger in the uphole direction with, or within, the wellbore fluid stream to convey the liquid in the uphole direction. This may include providing a motive force for removal of the liquid from the wellbore conduit and/or producing the liquid from the wellbore conduit and/or from the gaseous hydrocarbon well and is illustrated in FIG. 5. It is within the scope of the present disclosure that the conveying at 145 further may include conveying one or more solid materials from the wellbore conduit and/or producing the one or more solid materials from the gaseous hydrocarbon well. Accordingly, references to conveying, producing, and/or otherwise removing liquid from the wellbore conduit may additionally include removing solids, which as discussed may be referred to collectively with the liquid as "wellbore material."

As also discussed herein, it is within the scope of the present disclosure that the wellbore conduit may include and/or be a tapered wellbore conduit and/or that a cross-sectional shape and/or area of the wellbore conduit may vary along a length of the wellbore conduit. Under these conditions, methods 100 further may include selectively adjusting an outside diameter of the plunger, during the conveying, to correspond to a diameter of a portion of the wellbore conduit that includes the plunger.

It is also within the scope of the present disclosure that the plunger may be operated under conditions in which the flow of the wellbore fluid stream may be insufficient to convey the plunger in the uphole direction. Under these conditions, the plunger further may include a propulsion source that is configured to provide a motive force to convey the plunger in the uphole direction, and the conveying at 145 further may include actuating the propulsion source.

Determining the status of the plunger during the conveying at 150 may include determining any suitable property and/or status of the plunger during the conveying. As an illustrative, non-exclusive example, the determining at 150 may include determining a location of the plunger within the wellbore conduit, such as with the controller. As a more specific but still illustrative, non-exclusive example, the plunger may include a collar locator, and the determining may include counting tubing and/or casing collars with the collar locator as the plunger is conveyed therepast, comparing the counted collars to a collar log of collars that are present within the hydrocarbon well, and determining the location of the plunger based upon the comparison of the collar count to the collar log.

As another illustrative, non-exclusive example, the determining at 150 also may include determining a speed of the plunger within the wellbore conduit, such as with the controller. As an illustrative, non-exclusive example, the plunger may include an accelerometer, and the determining at 150 may include determining the speed based upon and/or utilizing the accelerometer. As another illustrative, non-exclusive example, the determining at 150 may include determining the speed based upon, or utilizing the collar locator and/or the collar log.

As yet another illustrative, non-exclusive example, the determining at 150 may include determining an acceleration of the plunger with the accelerometer. As another illustrative, non-exclusive example, the plunger may include a gyroscope, and the determining at 150 may include determining a trajectory of the plunger within the wellbore conduit with the gyroscope.

Figure 6:
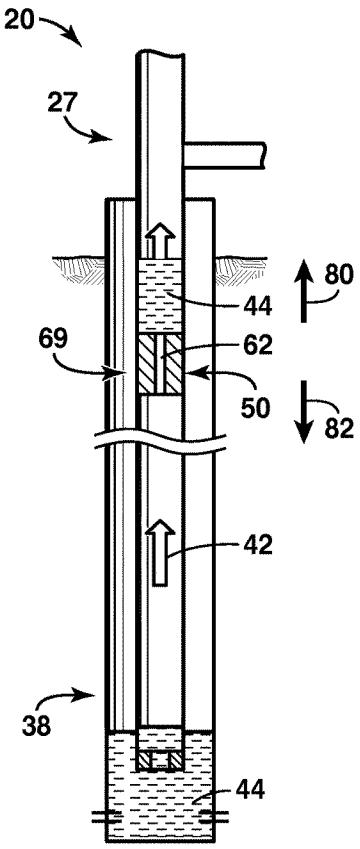
FIG. 6 is a schematic view of an illustrative, non-exclusive example of another portion of the process flow.

Regulating the motion of the plunger at 155 may include regulating the motion of the plunger in any suitable manner. As an illustrative, non-exclusive example, the regulating at 155 may include regulating the speed and/or velocity of the plunger within the wellbore conduit. This may include determining the speed of the plunger with the controller, such as via the determining at 150, and subsequently regulating the speed of the plunger with the controller, such as by controlling and/or regulating the fluid drag on the plunger within the wellbore conduit. This is illustrated in FIG. 6, where a size of flow-through opening 62 has been increased relative to that illustrated in FIGS. 4-5 to decrease the fluid drag on the plunger and decrease the speed of the plunger in the uphole direction.

It is within the scope of the present disclosure that the regulating at 155 may include decreasing the speed of the plunger in the uphole direction by any suitable amount, ceasing the motion of the plunger in the uphole direction, and/or even initiating motion of the plunger in the downhole direction. Additionally or alternatively, the regulating at 155 also may include increasing the speed of the plunger in the uphole direction. This increasing and/or decreasing may be based upon real-time data that is collected by the plunger during the conveying at 145 and/or upon historical data that has been previously collected by the plunger.

As an illustrative, non-exclusive example, the regulating at 155 may include maintaining the speed of the plunger below a threshold plunger speed. As another illustrative, non-exclusive example, the regulating at 155 may include increasing the fluid drag past the plunger within the wellbore conduit to increase the speed of the plunger while the plunger is conveyed in the uphole direction. As yet another illustrative, non-exclusive example, the regulating at 155 also may include decreasing the fluid drag past the plunger within the wellbore conduit to decrease the speed of the plunger while the plunger is conveyed in the uphole direction.

As another illustrative, non-exclusive example, the regulating at 155 also may include regulating a portion and/or fraction of a length of the wellbore conduit through which the plunger is conveyed during the conveying at 145. This may prevent contact between the plunger and a terminal end, such as at the surface region, of the wellbore conduit, thereby decreasing wear of and/or damage to the plunger and/or a remainder of the hydrocarbon well due to motion of the plunger within the wellbore conduit.

Figure 7:
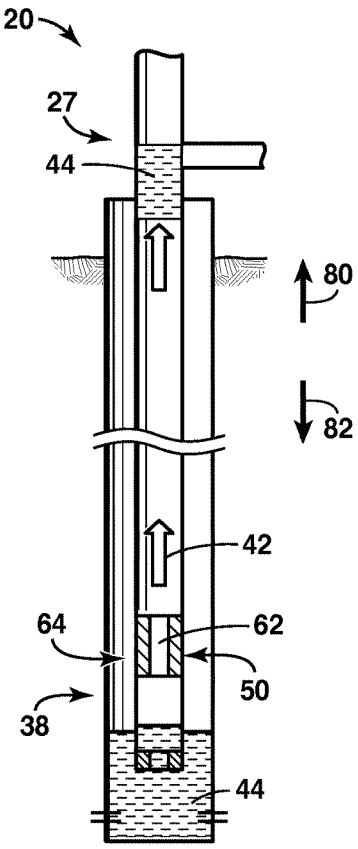
FIG. 7 is a schematic view of an illustrative, non-exclusive example of another portion of the process flow.

As an illustrative, non-exclusive example, the wellbore conduit may define a distance between the surface region and the target region of the wellbore conduit, as measured along the length of the wellbore conduit. The regulating at 155 may include calculating, during the conveying at 145, that a speed of the wellbore fluid stream is sufficient to convey the liquid to the surface region and decreasing the fluid drag on the plunger to cease conveying the plunger in the uphole direction. This may permit the plunger to be returned to the target region of the wellbore conduit prior to the plunger traversing the entire distance between the surface region and the target region of the wellbore conduit and/or prior to the liquid being produced from the wellbore conduit. This is illustrated in FIG. 7 and discussed in more detail herein.

It is within the scope of the present disclosure that the plunger may traverse any suitable portion of the distance between the surface region and the target region of the wellbore conduit. As illustrative, non-exclusive examples, the plunger may traverse less than 100%, less than 95%, less than 90%, less than 85%, less than 80%, less than 70%, less than 60%, or less than 50% of the distance between the surface region and the target region of the wellbore conduit.

Collecting traverse data with the plunger at 160 may include collecting any suitable downhole data with the plunger during the conveying at 145. As illustrative, non-exclusive examples, the collecting at 160 may include collecting the pressure of the wellbore fluid stream as a function of location within the wellbore conduit, collecting the temperature of the wellbore fluid stream as a function of location within the wellbore conduit, collecting the flow rate of the wellbore fluid stream as a function of location within the wellbore conduit, and/or collecting the density of the wellbore fluid stream as a function of location within the wellbore conduit. Additionally or alternatively, the collecting at 160 also may include collecting a traverse survey of the wellbore conduit and/or generating a database of traverse data.

Producing the liquid from the gaseous hydrocarbon well at 165 may include producing the liquid in any suitable manner. This may include removing the liquid from the gaseous hydrocarbon well, such as via a surface tree 27, as illustrated in FIG. 8.

Adjusting the threshold range at 170 may include adjusting the threshold range in any suitable manner and/or based upon any suitable criteria. As illustrative, non-exclusive examples, the adjusting at 170 may include increasing a lower and/or an upper limit of the threshold range, decreasing the lower and/or upper limit of the threshold range, broadening the threshold range, and/or narrowing the threshold range. As additional illustrative, non-exclusive examples, the adjusting at 170 may include adjusting the threshold range based, at least in part, on previously collected downhole data and/or previously collected traverse data.

Repeating the methods at 175 may include repeating any suitable portion of methods 100. As an illustrative, non-exclusive example, and as illustrated in FIG. 7, the repeating at 175 may include returning the plunger to the target region of the wellbore conduit. As another illustrative, non-exclusive example, and subsequent to returning the plunger to the target region of the wellbore conduit, the repeating at 175 further may include repeating at least the flowing at 115, the maintaining at 120, the transitioning at 135, and the conveying at 145 to convey a respective volume of liquid from the wellbore conduit.

It is within the scope of the present disclosure that the repeating at 175 may include repeating without shutting in the hydrocarbon well and may be performed a plurality of times to remove a respective plurality of volumes of liquid from the wellbore conduit. Methods 100 may be repeated automatically, such as under the control of the controller.

When methods 100 include the repeating at 175, the collecting at 130 may include collecting downhole data when the plunger is maintained within the target region of the wellbore conduit and/or generating a database of downhole data as a function of time. Similarly, and when methods 100 include the repeating at 175, the collecting at 160 may include collecting traverse data when the plunger is being conveyed within the wellbore conduit and/or generating a database of traverse data as a function of time.

Referring more specifically to the process flow of FIGS. 3-8, FIG. 3 illustrates plunger 50 being maintained within target region 38 of wellbore conduit 36, such as during the maintaining at 120 of methods 100. As illustrated in FIG. 3, plunger 50 and/or a drag-regulating structure 60 thereof may be in low fluid drag state 64 and wellbore fluid stream 42 may flow past plunger 50 within wellbore conduit 36. As an illustrative, non-exclusive example, plunger 50 may define flow-through opening 62 and the wellbore fluid stream may flow through the flow-through opening.

While the wellbore fluid stream is flowing past the plunger, liquid 44 may collect within the wellbore conduit and/or on uphole side 56 of the plunger. When the variable associated with the wellbore fluid stream is within the threshold range, which indicates that removal of liquid 44 from the wellbore conduit would improve the flow of the wellbore fluid stream within the wellbore conduit, and/or which indicates that removal of liquid 44 from the wellbore conduit would be beneficial to the operation of the hydrocarbon well, and as illustrated in FIG. 4, plunger 50 and/or drag-regulating structure 60 thereof may be transitioned to high fluid drag state 66, such as during the transitioning at 135 of methods 100. This may include at least partially restricting, blocking, and/or occluding flow of the wellbore fluid stream through flow-through opening 62, as illustrated.

Transitioning plunger 50 to high fluid drag state 66 may increase a resistance to the flow of wellbore fluid stream 42 past the plunger, which may generate a motive (or pressure) force that may convey the plunger in uphole direction 80, as illustrated in FIG. 5 and discussed with reference to the conveying at 145 of methods 100. Motion of plunger 50 in the uphole direction also may convey liquid 44 in the uphole direction, as illustrated.

As discussed with reference to the determining at 150 of methods 100, the plunger may be configured to determine one or more status thereof while being conveyed in the uphole direction. In addition, and as discussed with reference to the regulating at 155 of methods 100, the plunger may be configured to regulate the motion thereof while being conveyed in the uphole direction. Thus, the plunger may be configured to selectively vary a resistance to fluid flow therepast while being conveyed in the uphole direction. This is illustrated in FIG. 6, in which flow-through opening 62 has been partially opened to decrease the resistance to fluid flow past the plunger relative to the high fluid drag state and slow and/or cease motion of the plunger in the uphole direction. This may be referred to herein as an intermediate state 69 for plunger 50. FIG. 6 illustrates plunger 50 transitioning to an intermediate state that defines a larger flow-through opening 62 when compared to high fluid drag state 66 and a smaller flow-through opening when compared to low fluid drag state 64. However, it is within the scope of the present disclosure that the motion of the plunger may be regulated in any suitable manner.

As an illustrative, non-exclusive example, and as discussed herein with reference to the regulating at 155, plunger 50 may determine that it is unnecessary to be conveyed the entire distance to the surface region and instead may transition to low fluid drag state 64 prior to reaching surface tree 27. This may permit the plunger to fall away from liquid 44 in downhole direction 82 back to target region 38 while liquid 44 continues to flow in uphole direction 80 and/or from the hydrocarbon well. This is illustrated in FIG. 7, with liquid 44 being separated from plunger 50. Flow of wellbore fluid stream 42 continues to convey liquid 44 in the uphole direction; however, plunger 50 is free to fall in the downhole direction and/or toward target region 38.

Alternatively, and as illustrated in FIG. 8, the plunger may continue to be conveyed in the uphole direction until reaching surface tree 27. Under these conditions, the plunger may be retained within surface tree 27 at least temporarily. This may permit the plunger to be charged and/or may permit data to be transferred from the plunger, as discussed herein with reference to the powering at 110.

FIGS. 9-20 provide more specific but still illustrative, non-exclusive examples of plungers 50 according to the present disclosure and/or of components of plungers 50, including plungers 50 of FIGS. 1 and 3-8. Any of the structures and/or features that are discussed herein with any one of FIGS. 9-20 may be included in and/or utilized with any other of FIGS. 9-20 without departing from the scope of the present disclosure. Similarly, any of the structures and/or features that are discussed herein with reference to any of FIGS. 9-20 may be included in and/or utilized with plungers 50 of FIGS. 1 and 3-8 without departing from the scope of the present disclosure.

Figure 10:
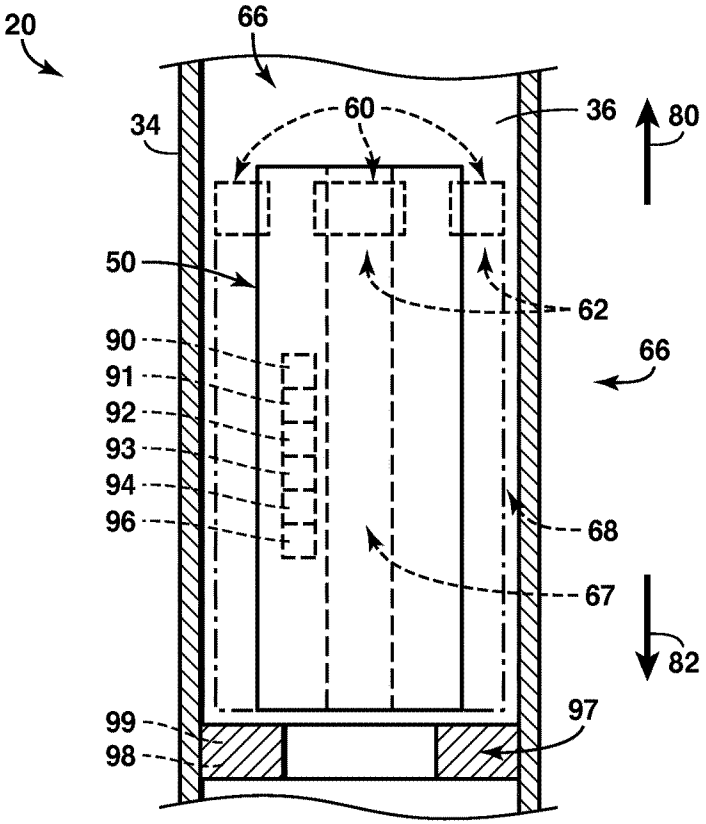
FIG. 10 is a schematic representation of illustrative, non-exclusive examples of a plunger according to the present disclosure in a high fluid drag state and located within a wellbore conduit.
Figure 9:
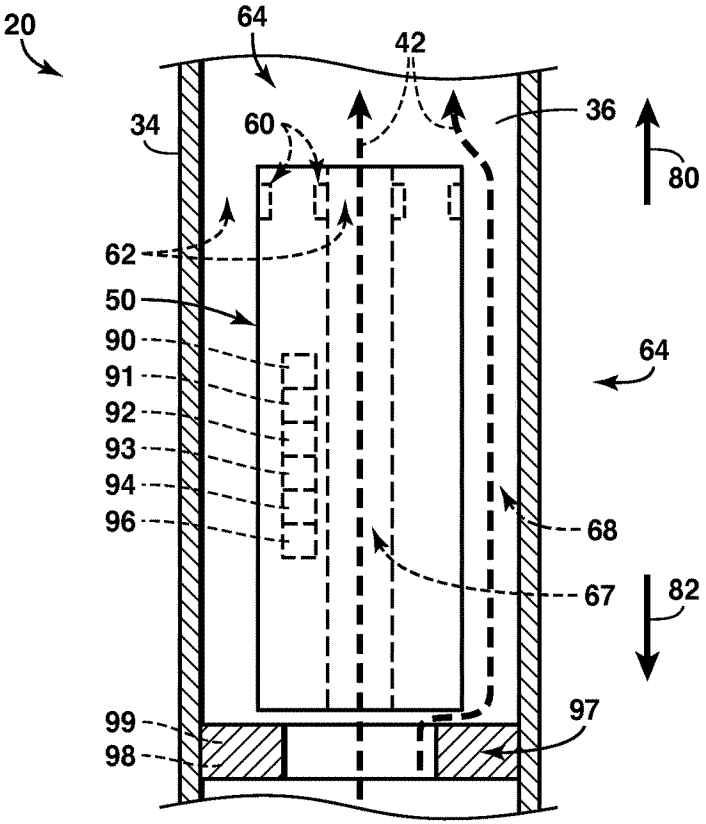
FIG. 9 is a schematic representation of illustrative, non-exclusive examples of a plunger according to the present disclosure in a low fluid drag state and located within a wellbore conduit.

FIGS. 9-10 are schematic representations of illustrative, non-exclusive examples of a plunger 50 according to the present disclosure located within a wellbore conduit 36. FIG. 9 illustrates plunger 50 in a low fluid drag state 64 and FIG. 10 illustrates plunger 50 in a high fluid drag state 66. Plunger 50 includes a drag-regulating structure 60 that is configured to regulate a fluid drag on the plunger when the plunger is located within wellbore conduit 36 and a wellbore fluid stream 42 flows past the plunger.

Plunger 50 also includes a controller 90. Controller 90 may be programmed to maintain drag-regulating structure 60 of plunger 50 in the low fluid drag state (as illustrated in FIG. 9) when a variable associated with the wellbore fluid stream is outside a threshold range. Controller 90 also may be programmed to selectively transition drag-regulating structure 60 of plunger 50 to high fluid drag state 66 (as illustrated in FIG. 10) responsive to the variable associated with the wellbore fluid stream being within the threshold range. As discussed in more detail herein, controller 90 further may be configured to adjust drag-regulating structure 60 to adjust the fluid drag on the plunger when the plunger is being conveyed within the wellbore. As an illustrative, non-exclusive example, plunger 50 and/or drag-regulating structure 60 thereof may at least partially define a flow-through opening 62, and drag-regulating structure 60 may be configured to transition to at least one intermediate state that is between low fluid drag state 64 and high fluid drag state 66 by changing the cross-sectional area of the flow-through opening.

As illustrated in FIGS. 9-10 at 67, flow-through opening 62 may be internal to and/or defined entirely by plunger 50. Additionally or alternatively, and as illustrated in FIGS. 9-10 at 68, flow-through opening 62 also may be defined between an external surface of plunger 50 and an internal surface of conduit body 34 and/or within an annular space that is defined between plunger 50 and conduit body 34.

Regardless of the exact configuration, and as discussed, drag-regulating structure 60 may be configured to selectively vary the cross-sectional area of flow-through opening 62 to selectively vary the resistance to flow of wellbore fluid stream 42 therethrough. This is illustrated in FIG. 10 by drag-regulating structure 60 at least partially blocking and/or occluding flow-through opening 62.

When flow-through opening 62 is defined between the external surface of plunger 50 and the internal surface of conduit body 34, the flow-through opening also may be referred to herein as an external flow-through opening 68. In such a configuration, drag-regulating structure 60 may be located within any suitable area and/or region along the external surface of plunger 50. Thus, and as illustrated in dashed lines, the drag-regulating structure may be located along a portion of a length of the external surface. Alternatively, and as illustrated in dash-dot lines in FIG. 10, the drag-regulating structure may be located along an entirety of the external surface.

When drag-regulating structure 60 is located along the external surface of plunger 50, the drag-regulating structure may include and/or be an expandable and/or a resilient drag-regulating structure 60 that may be configured to expand and/or contract to conform to a shape and/or diameter of wellbore conduit 36. This may permit the drag-regulating structure to maintain at least a threshold resistance to fluid flow past plunger 50 despite changes in the shape and/or diameter of wellbore conduit 36.

Figure 18:
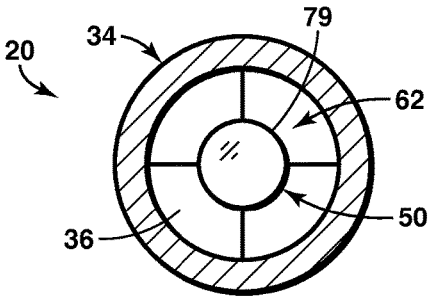
FIG. 18 is a schematic top view of the plunger of FIG. 17.
Figure 20:
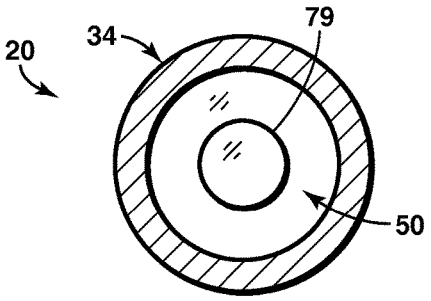
FIG. 20 is a schematic top view of the plunger of FIG. 19.
Figure 19:
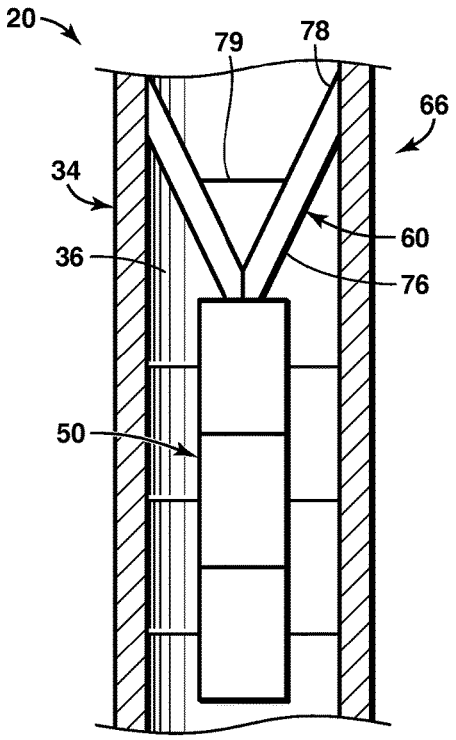
FIG. 19 is a schematic side view of illustrative, non-exclusive examples of a plunger according to the present disclosure in a high fluid drag state and located within a wellbore conduit.

FIGS. 11-20 provide less schematic but still illustrative, non-exclusive examples of plungers 50 according to the present disclosure and/or of components thereof. More specifically, FIGS. 11-16 provide less schematic but still illustrative, non-exclusive examples of drag-regulating structures 60 according to the present disclosure that may be internal to and/or defined within plungers 50 according to the present disclosure. In contrast, FIGS. 18-20 provide less schematic but still illustrative, non-exclusive examples of a plunger 50 according to the present disclosure that includes a drag-regulating structure 60 that is at least partially external to and/or defined on an external surface of plunger 50 according to the present disclosure.

Figure 11:
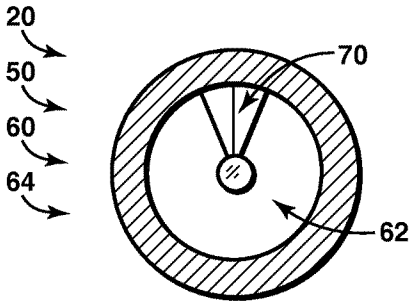
FIG. 11 is a schematic representation of an illustrative, non-exclusive example of a drag-regulating structure according to the present disclosure in a low fluid drag state.
Figure 12:
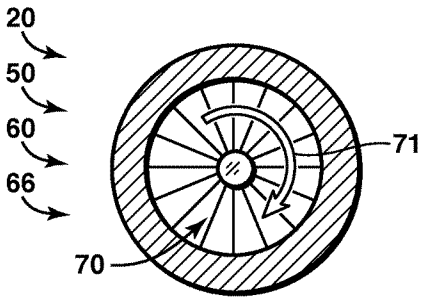
FIG. 12 is a schematic representation of an illustrative, non-exclusive example of the drag-regulating structure of FIG. 11 in a high fluid drag state.

FIG. 11 is a schematic representation of an illustrative, non-exclusive example of a drag-regulating structure 60 according to the present disclosure in a low fluid drag state 64, while FIG. 12 is a schematic representation of the drag-regulating structure of FIG. 11 in a high fluid drag state 66. In FIGS. 11-12, drag-regulating structure 60 includes a fan 70, which may be rotated (as indicated in FIG. 12 at 71) to transition between low fluid drag state 64 and high fluid drag state 66, and it is within the scope of the present disclosure that fan 70 also may be rotated to one or more intermediate states between the low fluid drag state and the high fluid drag state to define one or more intermediate fluid drag states and/or to define different cross-sectional areas for a flow-through opening 62.

Figure 13:
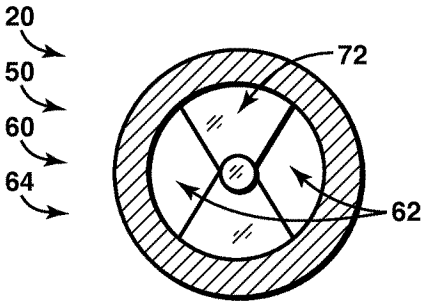
FIG. 13 is a schematic representation of an illustrative, non-exclusive example of a drag-regulating structure according to the present disclosure in a low fluid drag state.
Figure 14:
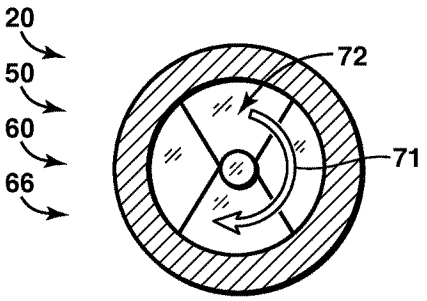
FIG. 14 is a schematic representation of an illustrative, non-exclusive example of the drag-regulating structure of FIG. 13 in a high fluid drag state.

FIG. 13 is a schematic representation of an illustrative, non-exclusive example of a drag-regulating structure 60 according to the present disclosure in a low fluid drag state 64, while FIG. 14 is a schematic representation of the drag-regulating structure of FIG. 13 in a high fluid drag state 66. In FIGS. 13-14, drag-regulating structure 60 includes a valve 72, which may be rotated (as indicated in FIG. 14 at 71) to transition between low fluid drag state 64 and high fluid drag state 66, and it is within the scope of the present disclosure that valve 72 also may be rotated to one or more intermediate states between the low fluid drag state and the high fluid drag state to define one or more intermediate fluid drag states and/or to define different cross-sectional areas for a flow-through opening 62.

Figure 15:
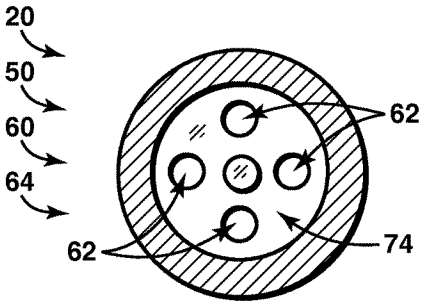
FIG. 15 is a schematic representation of an illustrative, non-exclusive example of a drag-regulating structure according to the present disclosure in a low fluid drag state.
Figure 16:
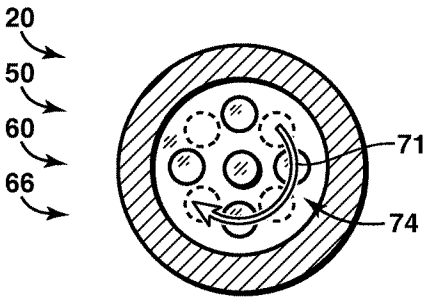
FIG. 16 is a schematic representation of an illustrative, non-exclusive example of the drag-regulating structure of FIG. 15 in a high fluid drag state.

FIG. 15 is a schematic representation of an illustrative, non-exclusive example of a drag-regulating structure 60 according to the present disclosure in a low fluid drag state 64, while FIG. 16 is a schematic representation of the drag-regulating structure of FIG. 15 in a high fluid drag state 66. In FIGS. 15-16, drag-regulating structure 60 includes a choke plate 74, which may be rotated (as indicated in FIG. 16 at 71) to transition between low fluid drag state 64 and high fluid drag state 66, and it is within the scope of the present disclosure that choke plate 74 also may be rotated to one or more intermediate states between the low fluid drag state and the high fluid drag state to define one or more intermediate fluid drag states and/or to define different cross-sectional areas for a flow-through opening 62.

Figure 17:
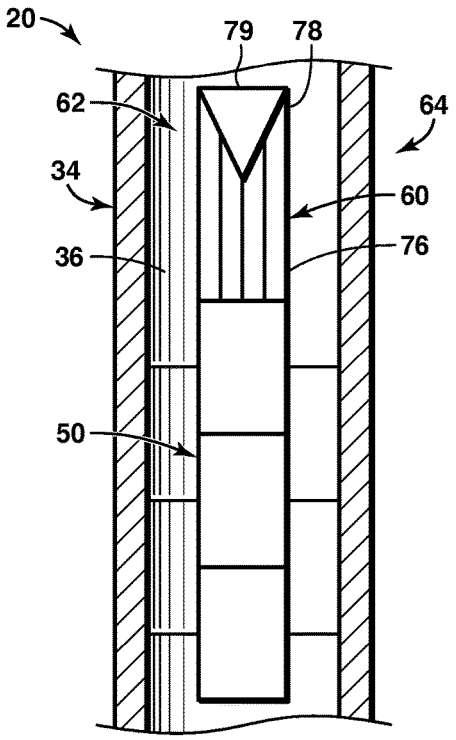
FIG. 17 is a schematic side view of illustrative, non-exclusive examples of a plunger according to the present disclosure in a low fluid drag state and located within a wellbore conduit.

FIG. 17 is a schematic side view of illustrative, non-exclusive examples of a plunger 50 according to the present disclosure in a low fluid drag state 64 and located within a wellbore conduit 36, while FIG. 18 is a schematic top view of the plunger of FIG. 17. FIG. 19 is a schematic side view the plunger of FIG. 17 in a high fluid drag state 66, while FIG. 20 is a schematic top view of the plunger of FIG. 19. In FIGS. 17-18, plunger 50 and conduit body 34 together define a flow-through opening 62 within an annular space therebetween. In addition, drag-regulating structure 60 is an expanding structure 76 that may be adjusted to vary the cross-sectional area of flow-through opening 62.

As an illustrative, non-exclusive example, drag-regulating structure 60 may include and/or be a cone 78 and screw 79 assembly. Under these conditions, screw 79 may be drawn toward a remainder of plunger 50, thereby expanding cone 78 and decreasing the cross-sectional area of flow-through opening 62, as illustrated in FIGS. 19-20. Conversely, and as illustrated in FIGS. 17-18, screw 79 may be extended away from a remainder of plunger 50, thereby permitting cone 78 to retract and increasing the cross-sectional area of flow-through opening 62.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of removing a liquid from a wellbore conduit with a plunger, the method comprising:

flowing a wellbore fluid stream in fluid contact with the plunger and in an uphole direction within the wellbore conduit, wherein the wellbore conduit is defined by a conduit body and extends within a wellbore, and further wherein the plunger is located within a target region of the wellbore conduit and is configured to selectively transition alternatively between a low fluid state and a high fluid drag state within the wellbore conduit, wherein the wellbore conduit defines a distance between a surface region and the target region of the wellbore conduit;

maintaining the plunger in the low fluid drag state while a variable associated with the wellbore fluid stream is outside a threshold range, wherein the maintaining permits the plunger to remain within the target region of the wellbore conduit during the flowing;

transitioning the plunger to the high fluid drag state responsive to the variable associated with the wellbore fluid stream being within the threshold range, wherein the transitioning includes increasing a resistance to fluid flow past the plunger within the wellbore conduit;

the plunger comprising a detector and a controller, the controller in communication with the detector;

configuring the detector to detect the variable associated with the wellbore fluid stream;

detecting with the detector that the variable associated with the wellbore fluid stream is within the threshold range;

initiating the transitioning with the controller responsive to the detecting;

subsequent to the transitioning, conveying the plunger in the uphole direction within the wellbore conduit with the wellbore fluid stream to convey the liquid in the uphole direction; and decreasing a fluid drag on the plunger, with the controller, to cease the conveying the plunger in the uphole direction and returning the plunger to the target region of the wellbore conduit without the plunger traversing the entire distance between the surface region and the target region of the wellbore conduit.

2. The method of claim 1, wherein the target region of the wellbore conduit is distal from an uphole end of the wellbore conduit.

3. The method of claim 1, wherein, during the conveying, the method further includes determining a location of the plunger within the wellbore conduit with the controller.

4. The method of claim 3, wherein the plunger further includes a collar locator, and the determining includes determining based, at least in part, on a collar log and data from the collar locator.

5. The method of claim 1, wherein, during the conveying, the method further includes determining a speed of the plunger within the wellbore conduit with the controller and regulating the speed of the plunger within the wellbore conduit with the controller.

6. The method of claim 5, wherein the regulating includes decreasing a fluid drag on the plunger within the wellbore conduit to decrease the speed of the plunger.

7. The method of claim 1, wherein the method includes calculating, with the controller, that a speed of the wellbore fluid stream is sufficient to convey the liquid to the surface region.

8. The method of claim 1, wherein the method further includes collecting downhole data with the detector, wherein the collecting includes collecting the downhole data while the plunger is within the target region of the wellbore conduit.

9. The method of claim 1, wherein the method further includes collecting downhole data with the detector, wherein the collecting includes collecting the downhole data during the conveying.

10. The method of claim 1, wherein the variable associated with the wellbore fluid stream includes a pressure of the wellbore fluid stream.

11. The method of claim 1, wherein the variable associated with the wellbore fluid stream includes a temperature of the wellbore fluid stream.

12. The method of claim 1, wherein the variable associated with the wellbore fluid stream includes a flow rate of the wellbore fluid stream past the plunger.

13. The method of claim 1, wherein the variable associated with the wellbore fluid stream includes a density of the wellbore fluid stream.

14. The method of claim 1, wherein the variable associated with the wellbore fluid stream includes a plurality of variables associated with the wellbore fluid stream, wherein the plurality of variables associated with the wellbore fluid stream includes at least two of a temperature of the wellbore fluid stream, a pressure of the wellbore fluid stream, a density of the wellbore fluid stream, and a flow rate of the wellbore fluid stream.

15. The method of claim 1, wherein, subsequent to the conveying, the method further includes repeating the method, wherein the repeating the method comprises:

returning the plunger to the target region of the wellbore conduit, wherein the returning includes returning the plunger to the target region of the wellbore conduit without shutting in the wellbore; and repeating the flowing, the maintaining, the transitioning, and the conveying.

16. The method of claim 1, wherein the method further includes releasing a supplemental material into the wellbore conduit, wherein the releasing includes at least one of:

(i) releasing the supplemental material from the plunger while the plunger is within the target region of the wellbore conduit; and (ii) releasing the supplemental material from the plunger while the plunger is being conveyed in the uphole direction within the wellbore conduit.

17. The method of claim 1, wherein the plunger includes a power source, wherein the method includes powering the plunger with the power source, wherein the method includes re-charging the power source, and further wherein the re-charging includes at least one of (i) re-charging while the plunger is located within the target region of the wellbore conduit and (ii) re-charging while the plunger is proximal to a surface tree that is associated with the gaseous hydrocarbon well.

18. The method of claim 17, wherein, during the re-charging, the method further includes conveying data from the plunger to a surface region.

19. The method of claim 1, wherein the method further includes locating the plunger within the target region of the wellbore conduit, wherein the locating includes at least one of:

(i) locating the plunger within the target region of the wellbore conduit without shutting in the wellbore; and (ii) locating without exposing the wellbore conduit to ambient atmospheric conditions.

20. A plunger configured to remove wellbore material from a wellbore, the plunger comprising:

a drag-regulating structure that is configured to selectively regulate a fluid drag on the plunger when the plunger is located within a wellbore conduit that is defined by a conduit body and a wellbore fluid stream flows past the plunger, wherein the wellbore conduit defines a distance between a surface region and the target region of the wellbore conduit;

a detector to detect a variable associated with the wellbore fluid stream;

an on-board controller in communication with the detector, wherein the controller is programmed to selectively transition the plunger alternatively between a low fluid drag state and a high fluid drag state within the wellbore conduit, and to:

(i) maintain the drag-regulating structure in the low fluid drag state while a variable associated with the wellbore fluid stream is outside a threshold range; and (ii) transition the drag-regulating structure to the high fluid drag state responsive to the variable associated with the wellbore fluid stream being within the threshold range; and (iii) decrease a fluid drag on the plunger, with the controller, to cease the conveying the plunger in the uphole direction and returning the plunger to the target region of the wellbore conduit without the plunger traversing the entire distance between the surface region and the target region of the wellbore conduit.

21. The plunger of claim 20, wherein the controller is further programmed to adjust the drag-regulating structure to adjust the fluid drag on the plunger when the plunger is being conveyed within the wellbore conduit.

22. The plunger of claim 20, wherein the drag-regulating structure defines a flow-through opening, and further wherein the drag-regulating structure is configured to transition to at least one intermediate state between the low fluid drag state and the high fluid drag state by changing a cross-sectional area of the flow-through opening.

23. A hydrocarbon well, comprising:

a wellbore that extends between a surface region and a subterranean formation;

a conduit body that defines a wellbore conduit that extends within the wellbore, wherein the wellbore conduit defines a distance between a surface region and the target region of the wellbore conduit;

a plunger located within a target region of the wellbore conduit, wherein the plunger comprises a drag-regulating structure that is configured to selectively regulate a fluid drag on the plunger when the plunger is located within the wellbore conduit wherein a wellbore fluid stream flows past the plunger;

a detector to detect a variable associated with the wellbore fluid stream;

an on-board controller in communication with the detector, wherein the controller is programmed to selectively transition the plunger alternatively between a low fluid drag state and a high fluid drag state within the wellbore conduit, and to:

(i) maintain the drag-regulating structure in the low fluid drag state while a variable associated with the wellbore fluid stream is outside a threshold range; and (ii) transition the drag-regulating structure to the high fluid drag state responsive to the variable associated with the wellbore fluid stream being within the threshold range; and (iii) decrease a fluid drag on the plunger, with the controller, to cease the conveying the plunger in the uphole direction and returning the plunger to the target region of the wellbore conduit without the plunger traversing the entire distance between the surface region and the target region of the wellbore conduit; and hydrocarbons produced from the hydrocarbon well comprising the plunger.

24. The hydrocarbon well of claim 23, wherein the hydrocarbon well further includes a downhole support structure that is configured to support the plunger when the plunger is located within the target region of the wellbore conduit.

25. The hydrocarbon well of claim 24, wherein the downhole support structure includes a downhole electrical connection that is configured to provide an electric current to the plunger when the plunger is supported by the downhole support structure, wherein the downhole support structure includes a downhole data transfer structure that is configured to permit data transfer from the plunger.

26. The hydrocarbon well of claim 23, wherein the hydrocarbon well further includes a surface tree that is configured to selectively regulate a flow of a wellbore fluid stream therethrough, wherein the hydrocarbon well further includes an uphole support structure that is configured to selectively retain the plunger and is proximal to the surface tree.

27. The hydrocarbon well of claim 26, wherein the uphole support structure includes an uphole electrical connection that is configured to provide an electric current to the plunger when the plunger is supported by the uphole support structure, and further wherein the uphole support structure includes an uphole data transfer structure that is configured to permit data transfer from the plunger.

* * * * *